US005432860A

United States Patent [19]

Kasajima et al.

[11] Patent Number: 5,432,860

[45] Date of Patent: Jul. 11, 1995

[54] SPEAKER SYSTEM

[75] Inventors: Syoji Kasajima; Noboru Kyouno; Kazumi Honma; Isao Otsuka, all of Nagaokakyo, Japan

[73] Assignee: Mitsubishi Denki Kabushiki Kaisha, Tokyo, Japan

[21] Appl. No.: 68,837

[22] Filed: May 27, 1993

Related U.S. Application Data

[63] Continuation of Ser. No. 650,168, Feb. 4, 1991, abandoned.

[30] Foreign Application Priority Data

Feb. 9, 1990 [JP] Japan ..... 2-30410
Jul. 10, 1990 [JP] Japan ..... 2-184522

[51] Int. Cl.[6] ..... H04R 25/00

[52] U.S. Cl. ..... 381/156; 381/158; 181/152

[58] Field of Search ..... 381/156, 158, 159; 181/148, 152, 156, 151, 184, 180, 185

[56] References Cited

U.S. PATENT DOCUMENTS

| | | | |
|---|---|---|---|
| 3,356,179 | 12/1967 | Tompkins | 181/152 |
| 3,982,607 | 9/1976 | Evans | 181/152 |
| 4,206,830 | 6/1980 | Sohma et al. | 181/152 |
| 4,314,620 | 2/1982 | Gollehon | 181/156 |
| 4,807,293 | 2/1989 | Weckler | 181/156 |
| 4,893,659 | 1/1990 | Tamura et al. | 381/156 |
| 5,115,883 | 5/1992 | Morikawa et al. | 181/152 |
| 5,233,136 | 8/1993 | Hamada | 181/152 |

FOREIGN PATENT DOCUMENTS

| | | | |
|---|---|---|---|
| 0336303 | 10/1989 | European Pat. Off. | 381/159 |
| 96782 | 12/1979 | Japan | 381/156 |
| 63-313998 | 12/1988 | Japan . | |
| 2289333 | 11/1990 | Japan . | |
| 4070199 | 3/1992 | Japan | 381/156 |

OTHER PUBLICATIONS

"National Technical Report" vol. 34 No. 5, Oct., 1988.

*Primary Examiner*—Curtis Kuntz
*Assistant Examiner*—Huyen D. Le

[57] ABSTRACT

A speaker system includes an acoustic horn disposed in a cabinet. The acoustic horn is cone-shaped, is composed of a porous sound absorbing material, and has an aperture for interconnecting a space at the rear of a speaker unit and a space in the acoustic horn. A sound absorbing member or a passive radiator is disposed at the aperture.

6 Claims, 12 Drawing Sheets

| | DISTRIBUTION OF OSCILLATION | WAVELENGTH (m) | RESONANCE FREQUENCY (Hz) |
|---|---|---|---|
| 1ST ORDER | L | $\lambda_1 = 4L$ | $f_1 = \frac{C}{4L}$ |
| 2ST ORDER | | $\lambda_2 = \frac{4}{3}L$ | $f_2 = \frac{3C}{4L}$ |
| 3ST ORDER | | $\lambda_3 = \frac{4}{5}L$ | $f_3 = \frac{5C}{4L}$ |
| | ---- | ---- | ---- |
| n-TH ORDER | | $\lambda_n = \frac{4}{2n-1}L$ | $f_n = \frac{(2n-1)C}{4L}$ |
| | ---- | ---- | ---- |

Fig.14

SPEAKER SYSTEM

This application is a continuation of application Ser. No. 07/650,168 filed on Feb. 4, 1991, now abandoned.

BACKGROUND OF THE INVENTION

1. Field of the Invention

This invention relates to a speaker system including an acoustic horn disposed in a cabinet.

2. Description of the Related Art

A variety of speaker systems have been used for various audio systems. For example, a speaker system having a large sound output is used in a concert hall, while a compact speaker system is used in a television receiver. A bass reflection type speaker system is popular as a speaker system which is small but is able to radiate powerful low tones.

An example of a conventional bass reflection type speaker system is shown in FIGS. 1 and 2 of the accompanying drawings. FIG. 1 is a front elevational view, and FIG. 2 is a cross-sectional view taken along line II—II' of FIG. 1.

As shown in FIGS. 1 and 2, a speaker system 10 includes a hollow cabinet 12, and a speaker unit 14. The front peripheral edge of the speaker unit 14 is joined with a peripheral edge of a sound radiating aperture 12A on a front panel 12F of the cabinet 12. An acoustic port 18 is disposed in the cabinet 12.

Sound 100 from the front side of the speaker unit 14 is radiated forwardly via the sound radiating aperture 12A. Sound 101 from the rear of the speaker unit 14 is reflected by a rear panel 12R of the cabinet 12, thereby becoming a reflected sound 102. The reflected sound 102 is radiated forwardly via the acoustic port 18.

With the bass reflection type speaker unit, the sound 100 from the front side of the speaker unit 14 is added to the reflected sound 102, thereby becoming more powerful low tones.

FIG. 3 illustrates an example of a conventional speaker system including a passive radiator. The speaker system 20 comprises a cabinet 22, a speaker unit 24, and a passive radiator 26 which blocks an aperture 22B on a front panel 22F of the cabinet 22. To be more specific, a damping member 28 such as rubber is disposed between the front panel 22F and the passive radiator 26 so that the passive radiator 26 is freely vibratory back and forth.

Sound 104 from the rear of the speaker unit 24 is reflected by the rear panel 22R, and vibrates the passive radiator 26. The vibrating passive radiator 26 radiates sound 105 from its front side.

The sound 105 radiated by the passive radiator 26 is added to the sound 103 from the front side of the speaker unit 24, thereby intensifying the low tones. The speaker system of FIG. 3 is cited from "Speaker System, Vol. II," page 284 (FIG. 8.34), by Takeo Yamamoto, First Issue of Radio Technology, Jul. 15, 1979.

The speaker systems described above include small cabinets, but can offer abundant low tones.

However both of the speaker systems require apertures 12B and 22B on the front panels, which are difficult to decrease in size.

Particularly since it is required to install a small speaker system in a television receiver, the foregoing speaker systems are difficult to reduce the size of the front panel due to the apertures 12B and 22B.

SUMMARY OF THE INVENTION

It is therefore an object of this invention to provide a speaker system which can solve the problems of the conventional speaker system described above. The speaker system of the present disclosure has a smaller front panel, but can offer powerful low tones.

According to the invention, there is provided a speaker system having: a hollow cabinet including on its front panel a sound radiating aperture. A speaker unit; and an acoustic horn for receiving sound from the front side of said speaker unit and for transmitting the sound to said sound radiating aperture are in the hollow cabinet.

The acoustic horn is cone-shaped with its diameter being gradually increased from a sound receiving aperture to a sound transmitting aperture.

The acoustic horn is provided with at least one reflected-sound aperture through which the sound coming from the rear of said speaker unit and reflected by a rear panel of said hollow cabinet is guided into the internal space of said acoustic horn, so that the sound is then added to the sound from the front side of said speaker unit and is then radiated through said sound radiating aperture.

The peripheral edge of the sound receiving aperture is joined to the peripheral edge of the speaker unit. The peripheral edge of the sound transmitting aperture is joined to the peripheral edge of the sound radiating aperture.

In a first embodiment of the invention, the reflected sound aperture is covered by a sound absorbing material, which passes low tones freely, but absorbs high tones.

In a further embodiment, a passive radiator is disposed at the sound reflecting aperture, which effectively radiates, to the front side of the cabinet, the sound which comes from the rear of the speaker unit and has an inverted phase.

According to the invention, the speaker system has a compact front panel and can radiate very powerful and rich low tones.

BRIEF DESCRIPTION OF THE DRAWINGS

FIG. 14 shows the relationship between length of a closed pipe and a resonance frequency;

DETAILED DESCRIPTION

The principle of this invention is particularly useful when embodied in speaker systems such as shown in accompanying drawings.

Embodiment 1

Figure 2:
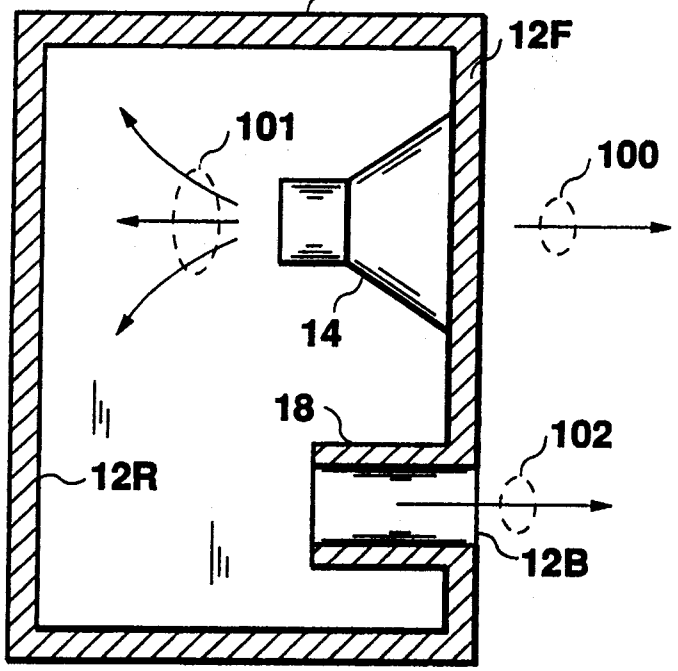
Fig.2 PRIOR ART
FIG. 2 is a side cross-sectional view taken along line II—II' of FIG. 1.
Figure 1:
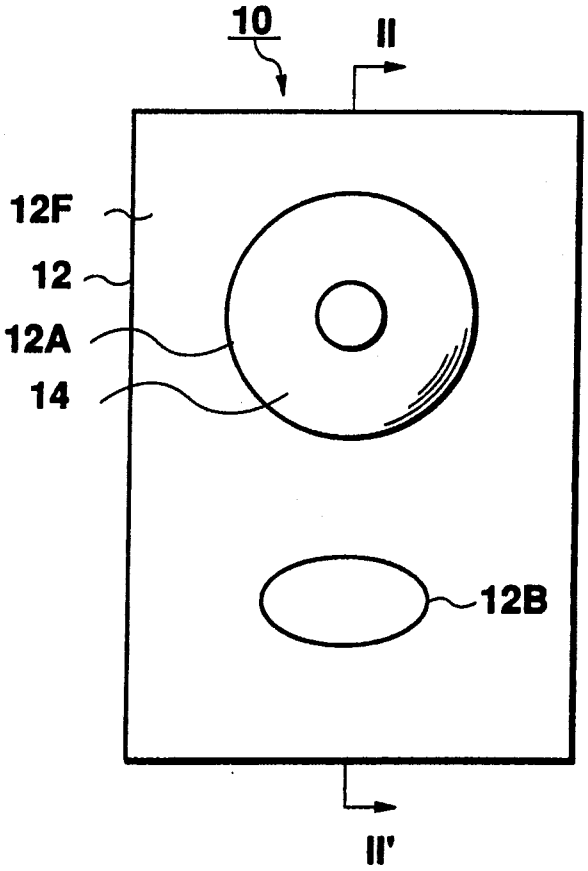
Fig.1 PRIOR ART
FIG. 1 is a front elevation of a conventional bass reflection type speaker system.
Figure 3:
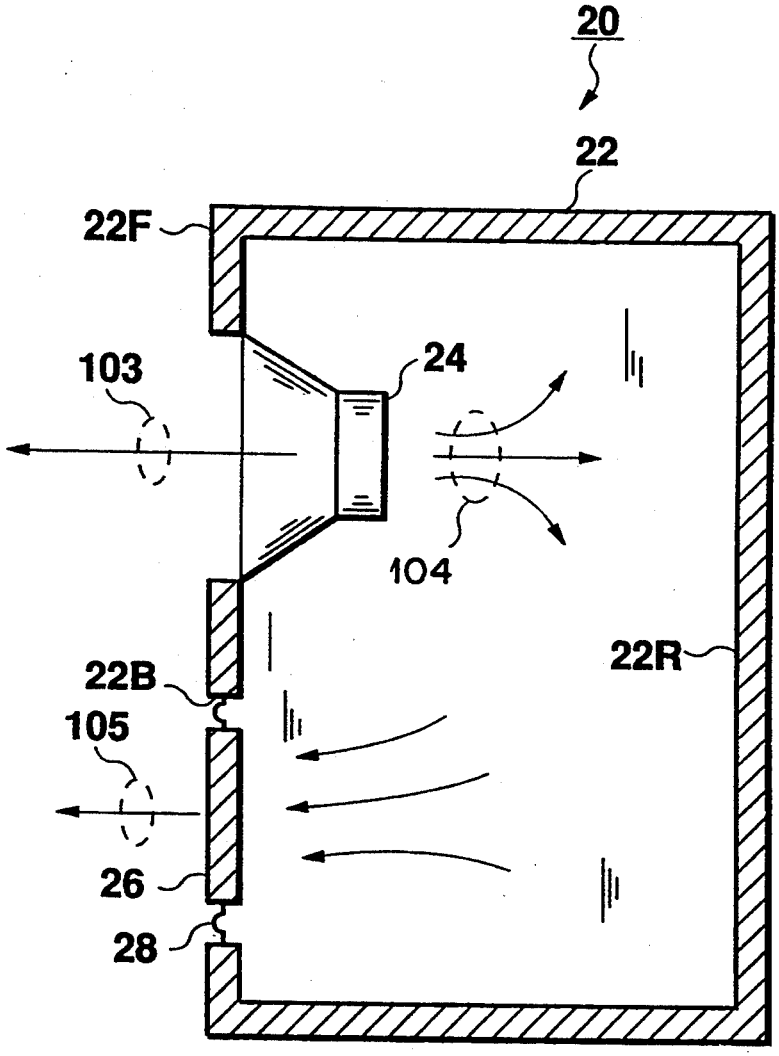
Fig.3 PRIOR ART
FIG. 3 is a cross-sectional view showing a conventional speaker system including a passive radiator.
Figure 5:
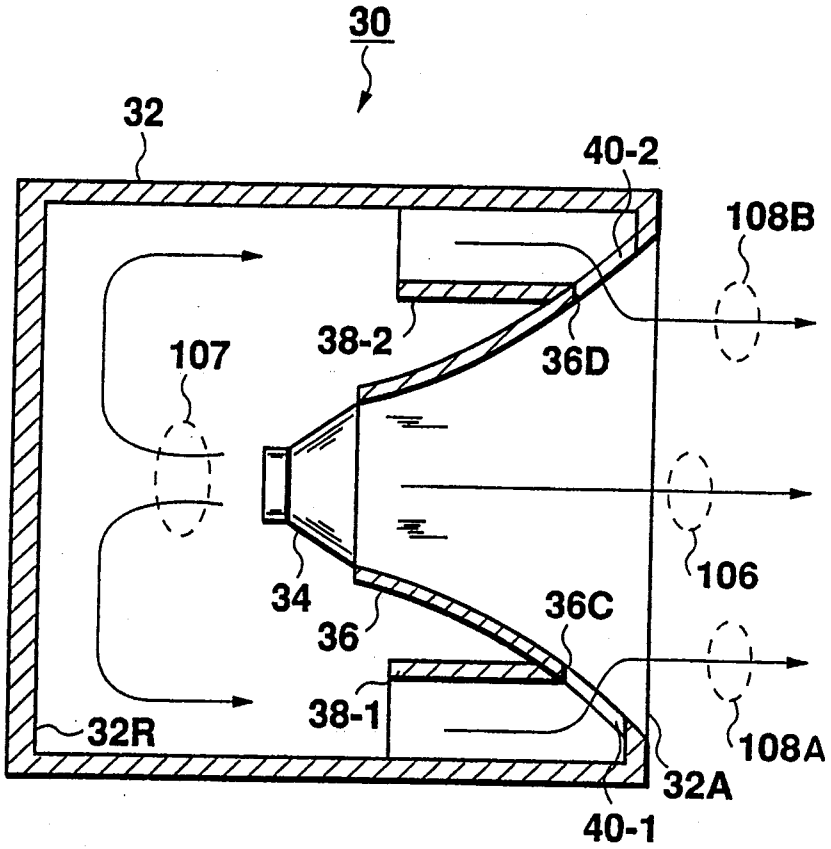
FIG. 5 is a side cross-sectional view taken along line V—V' of FIG. 4.
Figure 4:
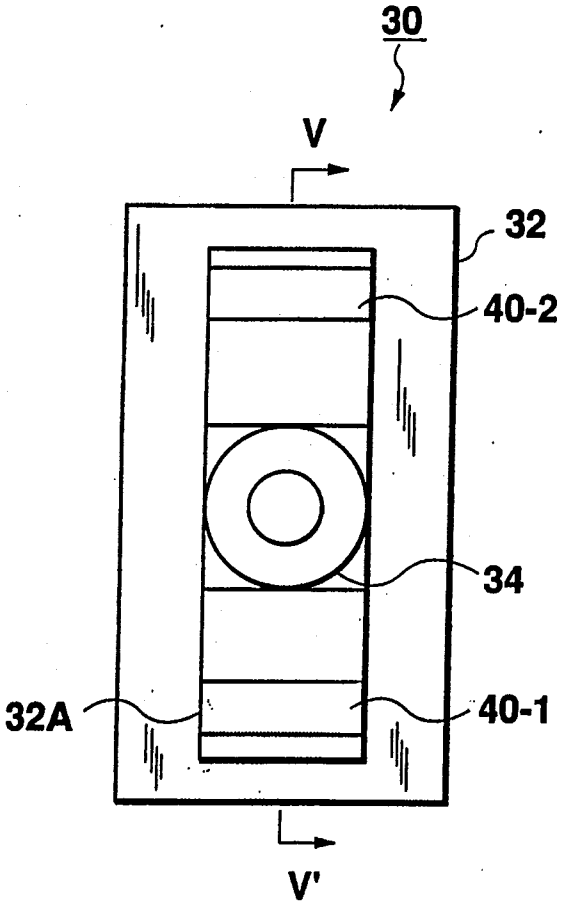
FIG. 4 is a front elevation showing a speaker system according to a first embodiment of the invention.

A speaker system 30 shown in FIGS. 4 and 5 is of a bass reflection type, and comprises a hollow cabinet 32, a speaker unit 34 for radiating sound, and an acoustic horn 36 for guiding the sound from the front side of the speaker unit 34 to a front sound radiating aperture 32A on the cabinet 32.

One of apertures of the acoustic horn 36 is used for receiving the sound, and the other aperture is for transmitting the sound. The peripheral edge of the sound receiving aperture is joined with the front peripheral edge of the speaker unit 34, while the peripheral edge of the sound transmitting aperture is joined with the peripheral edge of the sound radiating aperture 32A on the cabinet 32. As shown in FIG. 5, the acoustic horn 36 is cone-shaped.

There are disposed two reflected-sound apertures 36C, 36D in the vicinity of the sound radiating aperture of the acoustic horn 36. In the cabinet 32 are disposed two hollow acoustic ports 38-1, 38-2, one end each of which is joined with the reflected-sound apertures 36C, 36D, respectively.

The reflected-sound apertures 36C, 36D are covered with sound absorbing members 40-1, 40-2 in accordance with the shape of the acoustic horn 36. In this embodiment, the sound absorbing members 40-1, 40-2 are made of glass wool, and are about 1 cm thick. Since it is easy to deform, the glass wool is sandwiched between inner and outer nets (not shown).

The acoustic horn 36 is about 0.5 to 1 cm thick, and is composed of a material such as wood, plastics, or metal. This holds true to the acoustic ports 38-1, 38-2.

The sound 106 from the front side of the speaker unit 34 is guided forwardly via the acoustic horn 36. The sound 107 from the rear of the speaker unit 34 is reflected by the rear panel 32R of the cabinet 32, passes through the acoustic ports 38-1, 38-2, the reflected-sound apertures 36C, 36D, and the internal space of the acoustic horn 36, and is radiated forwardly of the cabinet 32. In FIG. 5, reference numerals 108A, 108B represent the sounds which are radiated through the reflected-sound apertures 36C, 36D.

The reflected sounds 108A, 108B are caused to pass through the sound absorbing members 40-1, 40-2, which absorb high tones of these sounds. In addition, the sound absorbing members 40-1, 40-2 improve the acoustic characteristics of the sounds 108A, 108B. In other words, although certain frequencies are intensified depending upon the size of the hollow space of the cabinet 32 or other factors, the sound absorbing members function to suppress the peaks of such frequencies.

Since the sound absorbing members 40-1, 40-2 are shaped in accordance with the shape of the acoustic horn 36, they can guide the sound 106 forwardly to the front side of the cabinet without adversely affecting the acoustic characteristics of the sound 106. Further, the sound absorbing members 40-1, 40-2 serve to prevent the sound 106 from reaching the rear side of the cabinet through the reflected-sound apertures 36C, 36D.

According to the foregoing embodiment, the reflected sounds 108A, 108B including the intensified low tones are added to the sound 106 from the front of the speaker unit 34, so that very powerful sounds can be radiated from the speaker system. In addition, the cabinet can be made compact by disposing the reflected-sound apertures 36C, 36D as parts of the acoustic horn 36.

It is preferable that the reflected-sound apertures 36C, 36D be disposed far from the speaker unit 34 as possible so as to prevent the sound 106 from reaching the interior of the cabinet through the apertures 36C, 36D as possible.

Figure 7:
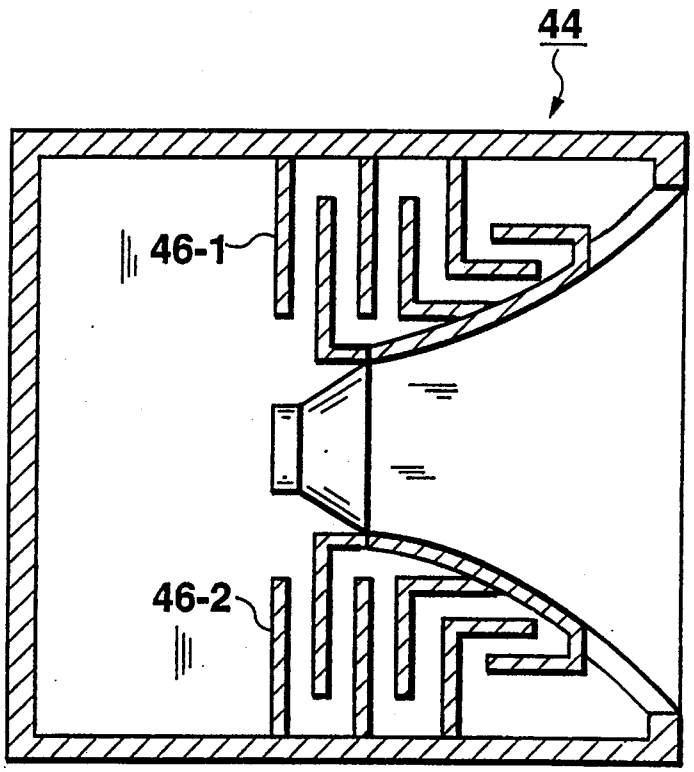
FIGS. 6 and 7 are side cross-sectional views showing modifications of the speaker system of the first embodiment.
Figure 6:
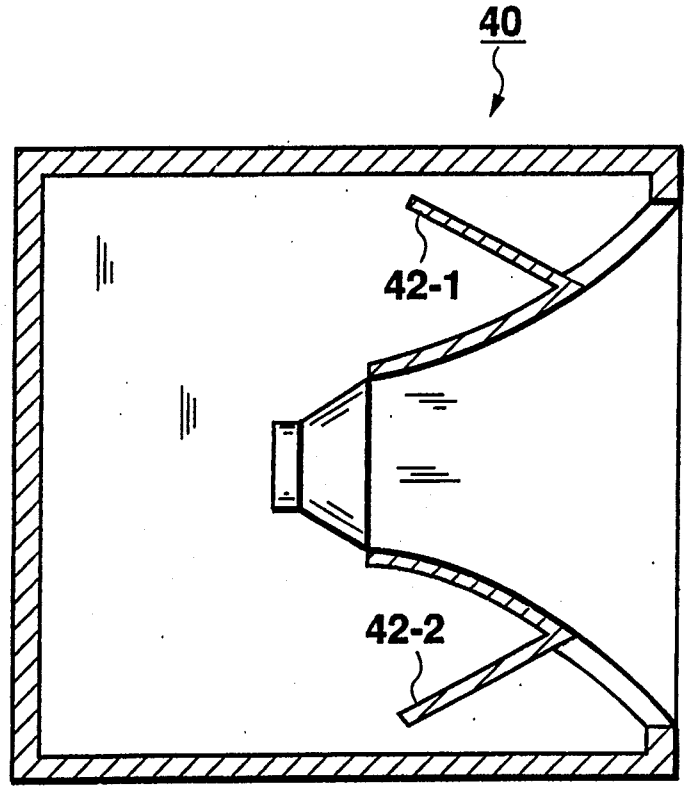

FIGS. 6 and 7 illustrate modifications of the speaker system 30.

A speaker system 40 of FIG. 6 features that entrances of acoustic ports 42-1, 42-2 are narrowed.

A speaker system 44 of FIG. 7 includes acoustic labyrinths 46-1, 46-2. The acoustic labyrinths can lengthen paths through which the reflected sounds pass so that much lower tones can be intensified.

In the speaker systems 40, 44, the reflected-sound apertures are disposed as parts of the acoustic horn, so that the overall speaker system can be made compact.

Embodiment 2

Figure 9:
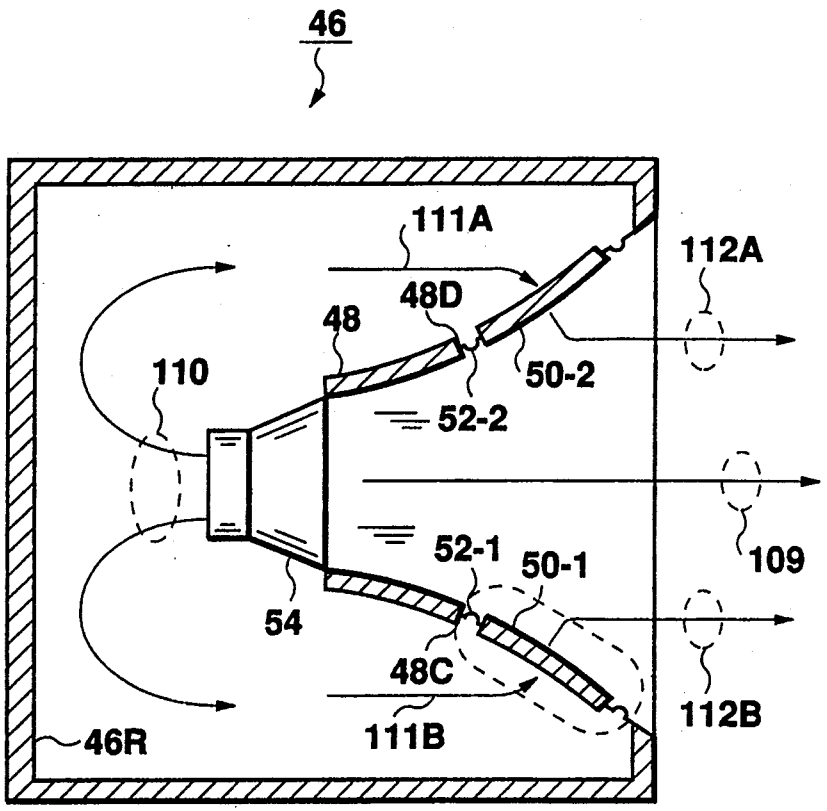
FIG. 9 is a side cross-sectional view taken along line IX—IX' of FIG. 8.
Figure 8:
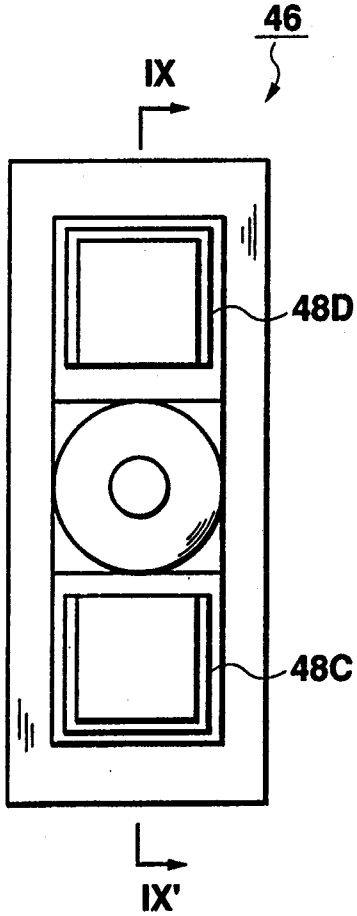
FIG. 8 is a front elevation showing a speaker system according a second embodiment of the invention.

FIGS. 8 and 9 show a speaker system according to a second embodiment of the invention.

In a speaker system 46, an acoustic horn 48 is provided with apertures 48C, 48D, which include passive radiators 50-1, 50-2. The passive radiators 50-1, 50-2 are vibratory back and forth by damping members 52-1, 52-2 made of rubber, for example.

With this arrangement, sound 110 from the rear of a speaker unit 54 is reflected by a rear panel 46R of the cabinet, and becomes reflected sounds 111A, 111B, which vibrate the passive radiators 50-1, 50-2. The vibrating passive radiators 50-1, 50-2 change the reflected sounds 111A, 111B into sounds 112A, 112B, which are added to the sound 109 from the front side of the speaker unit 54.

The sounds 112A, 112B include intensified low tones, and can compensate for insufficiency of low tones caused by the small cabinet. In other words, the speaker system can offer powerful and rich sounds.

With the speaker system 46, the passive radiators 50-1, 50-2 are disposed in the cabinet together with the acoustic horn 48, so that the front panel of the cabinet can be made small and that the entire speaker system can be made compact.

Figure 10:
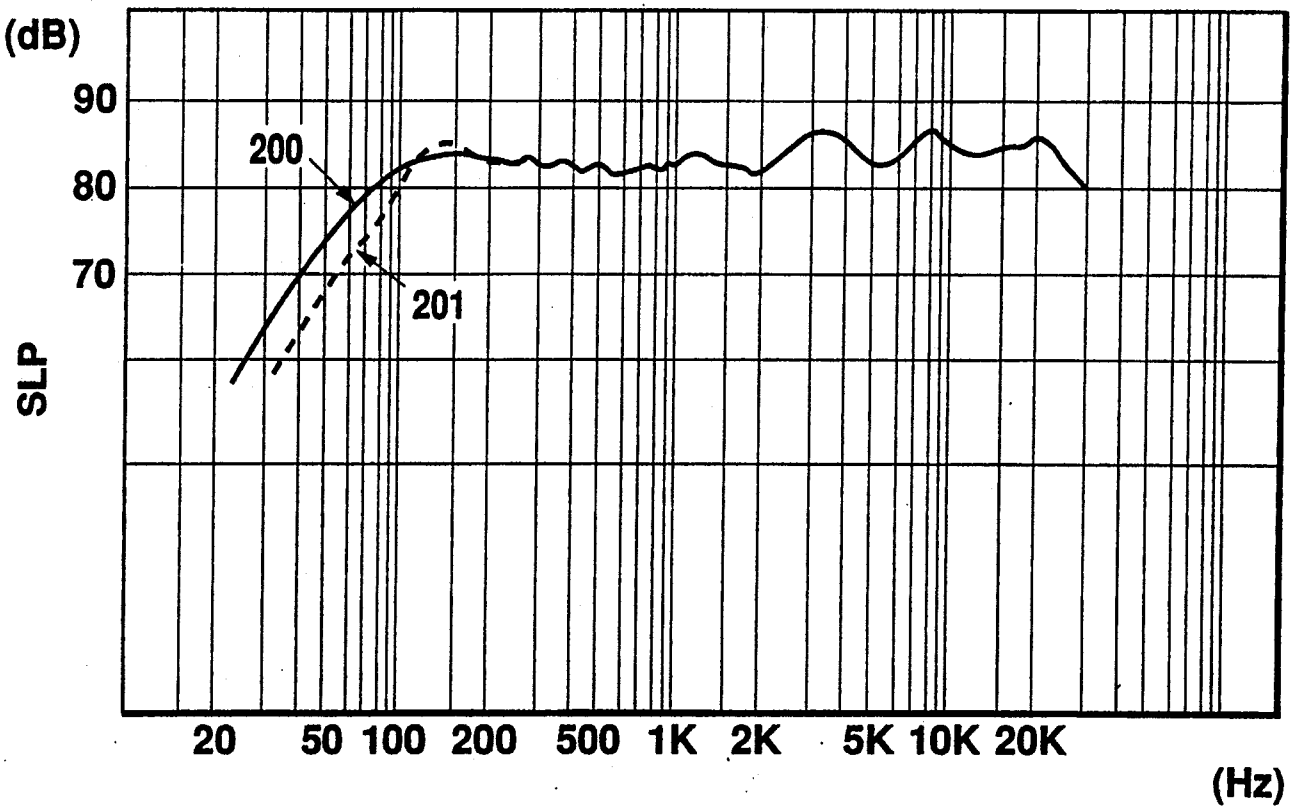
FIG. 10 shows acoustic characteristics of the speaker system according to the second embodiment.

FIG. 10 shows the relationship between the frequency and sound pressure level (SPL). In FIG. 10, a curve 200 represents the acoustic characteristics of the speaker system 46, while 201 does the acoustic characteristics of a comparison speaker system which does not have apertures such as apertures 48C, 48D in the acoustic horn 48.

As can be clearly seen in FIG. 10, disposition of the passive radiators 50-1, 50-2 can increase the sound pressure between about 20 Hz and 100 Hz. According to the second embodiment, the speaker system 48 can offer powerful low tones even though the cabinet is made compact.

It is needless to say that certain frequencies can be intensified as desired by changing the weight of the passive radiators 50-1, 50-2.

Figure 11:
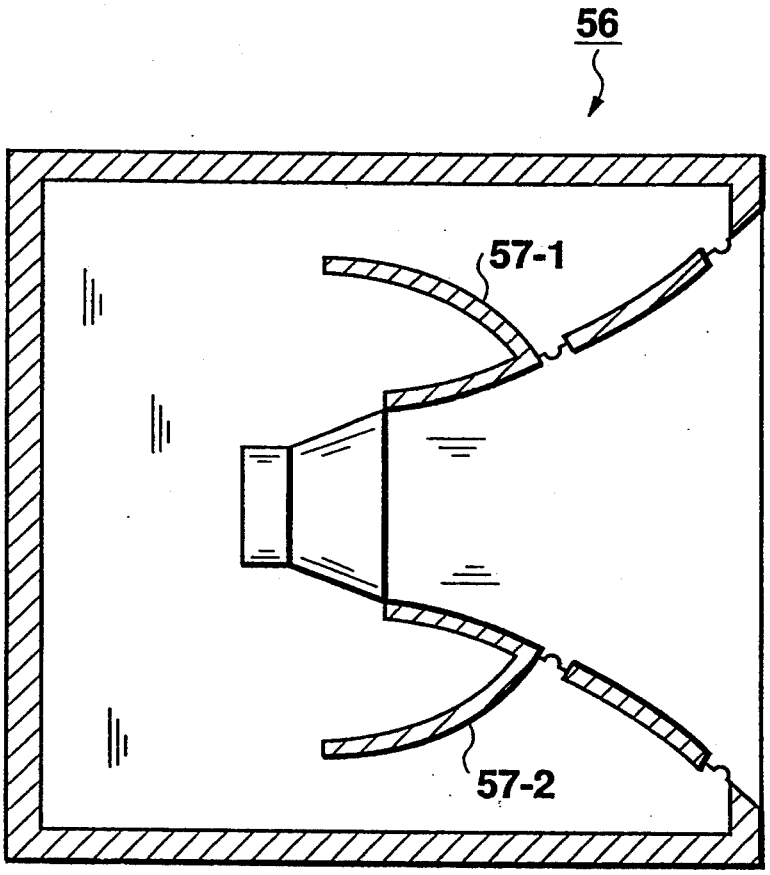
FIG. 11 is a side cross-sectional view showing a modification of the speaker system of the second embodiment.

FIG. 11 shows a modification of the speaker system 46 of FIGS. 8 and 9.

A speaker system 56 of FIG. 11 is characterized in that acoustic ports 57-1, 57-2 are disposed in the cabinet so as to intensify much lower tones.

Embodiment 3

Figure 12:
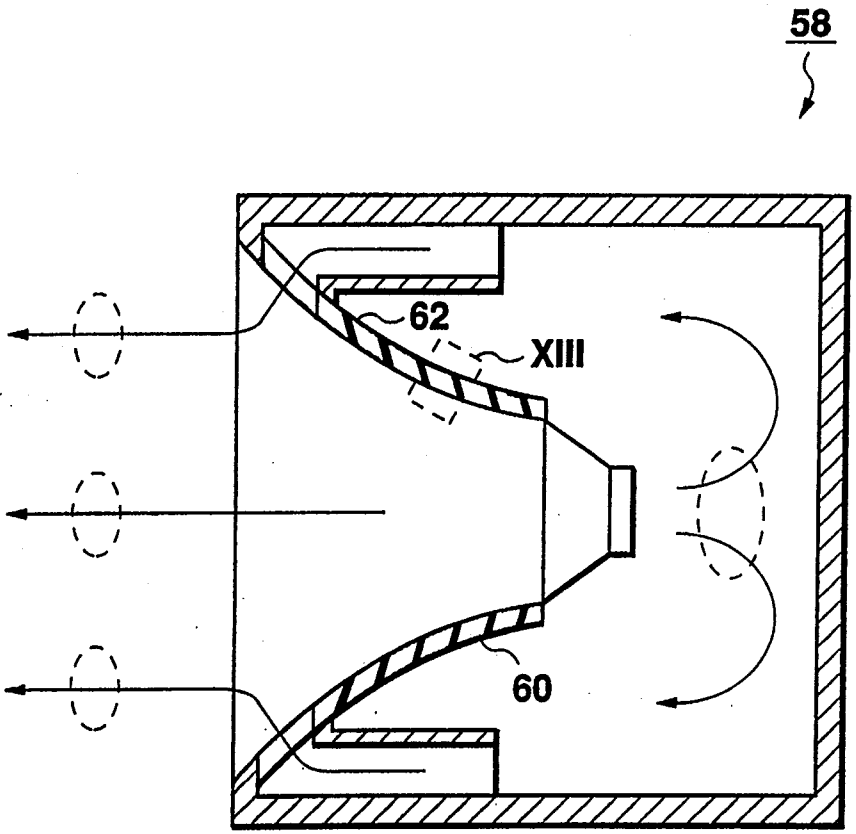
FIG. 12 is a side cross-sectional view showing a speaker system according to a third embodiment.

FIG. 12 illustrates a speaker system 58 according to a third embodiment of the invention.

The speaker system 58 features that it includes an acoustic horn 60 composed of a porous sound absorbing material. The components other than the acoustic horn 60 are the same as those of the speaker system of FIGS. 4 and 5, and will not be described in detail.

Figure 13:
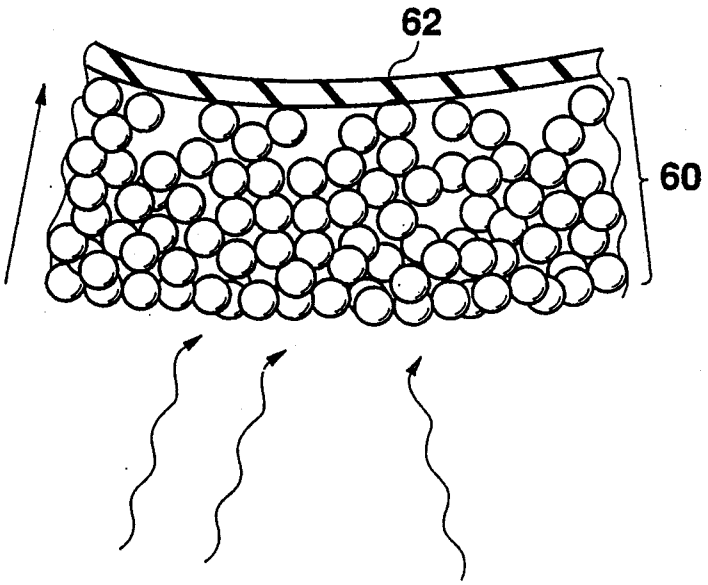
FIG. 13 shows a partial cross-sectional view of the acoustic horn of FIG. 12.

A cross-sectional view of the acoustic horn 60 at the position XIII of FIG. 12 is shown in FIG. 13. In FIG. 13, legend Z represents the thickness direction of the acoustic horn 60 (in the direction perpendicular to the plane of the drawing).

A porous sound absorbing member composing the acoustic horn 60 is made of a number of bonded particles such as plastics having a diameter of about 1 to several millimeters. The particles are thermally bonded, for example. Reference is made to Japanese Patent Laid-Open Publication No. 289333/1990 for the method of manufacturing the porous sound absorbing material.

Since the acoustic horn is a closed pipe, it is actually difficult to make the horn long enough. In addition, so-called resonance will be caused in such a horn.

FIG. 14 shows how the resonance occurs. The resonance will be caused at certain frequencies f in a closed pipe having a length L. Legend C stands for a sonic speed.

Figure 17:
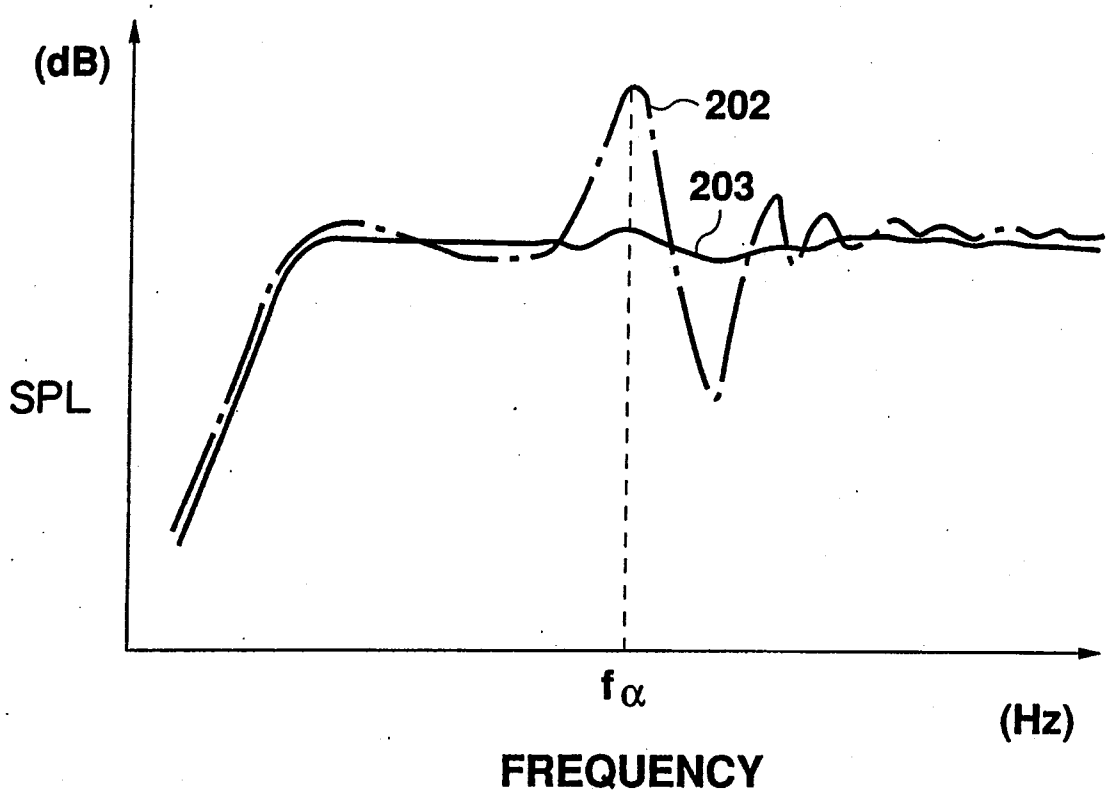
FIG. 17 is a graph showing the comparison of frequency characteristics between an acoustic horn 203 composed of a porous sound absorbing material and an acoustic horn 202 without a porous sound absorbing material.

As shown in FIG. 14, the resonance is caused in an acoustic horn of a speaker system. The curve 202 in FIG. 17 represents the resonance in the acoustic horn. The curve 202 indicates that a peak appears at a certain frequency fa and a dip does near the peak. In the speaker system 58, a porous sound absorbing material is used in the acoustic horn 60 so as to suppress the frequency peak and dip.

Figure 15:
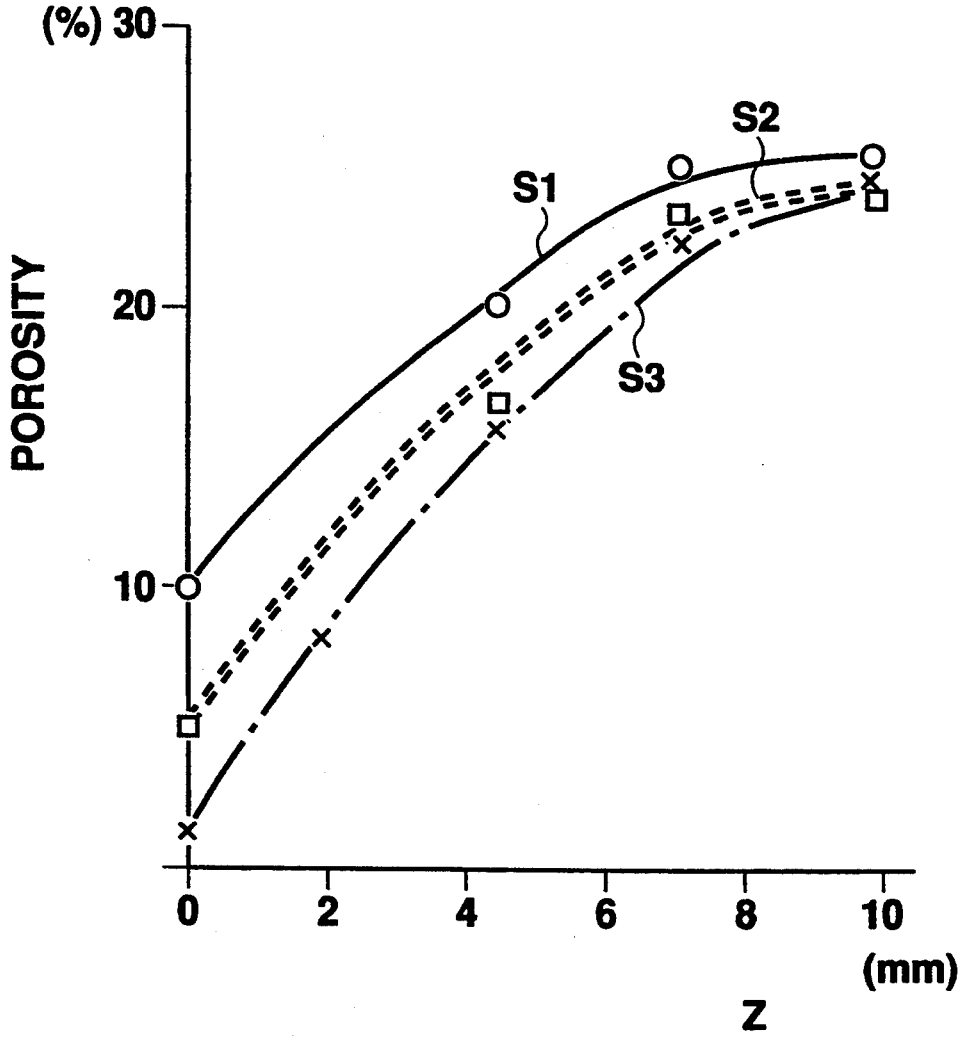
FIG. 15 is a graph showing the porosity of the acoustic horn in the thickness direction thereof.

FIG. 15 shows porosity of three kinds of porous sound absorbing materials S1 to S3. In these materials, the porosity is increased in the thickness direction Z of the acoustic horn. In other words, the porosity is the smallest on the surface of the acoustic horn where the sound impinges, and is gradually increased toward the outermost part of the horn, i.e., in the direction Z.

Figure 16:
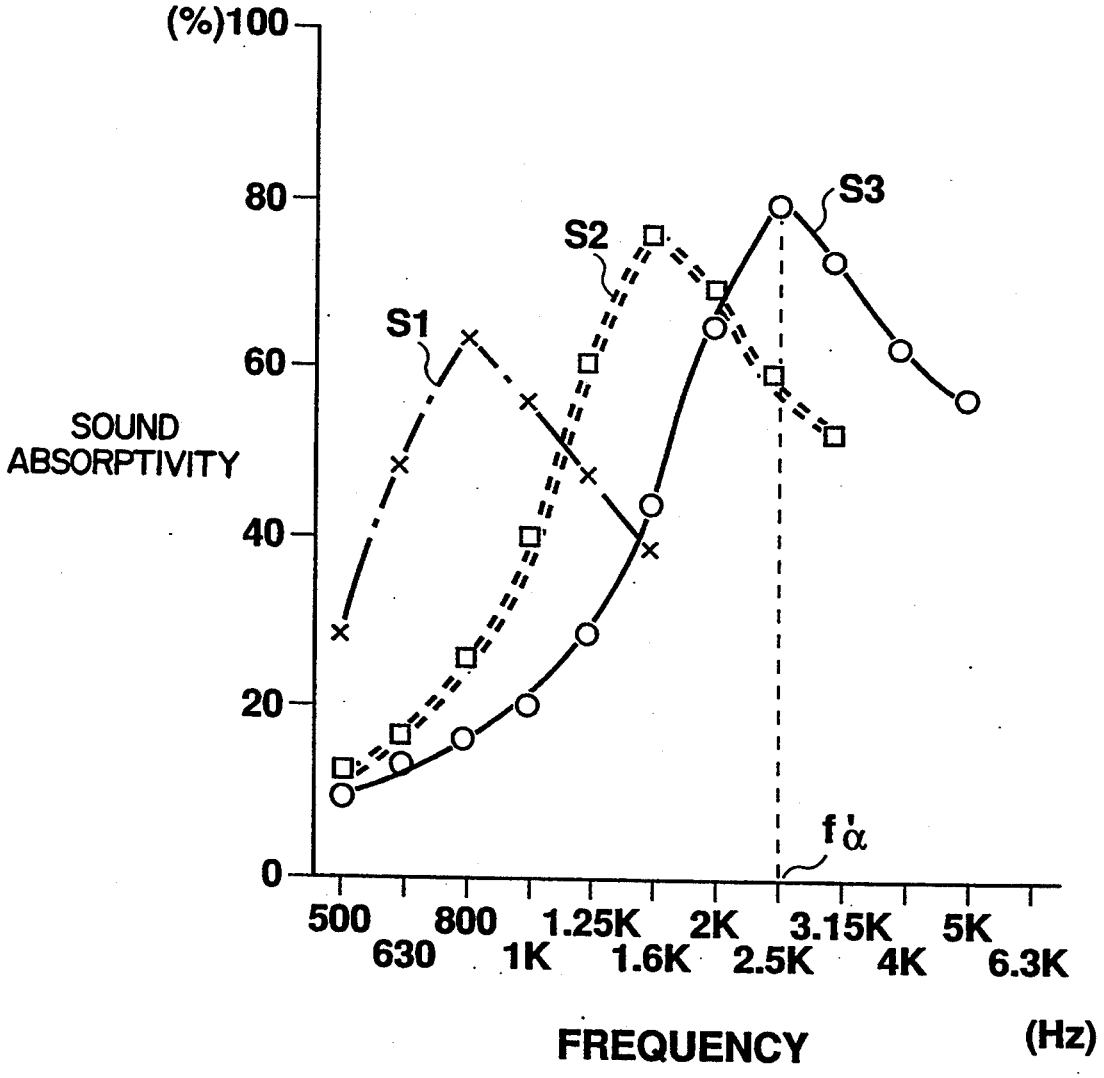
FIG. 16 is a graph showing frequency versus sound absorptivity of a porous sound absorbing material.

The sound absorbing characteristics of the materials S1 to S3 are shown in FIG. 16. In FIG. 16, the axis of abscissae represent the frequency, and the axis of ordinates does the sound absorptivity.

As shown in FIG. 16, the materials S1 to S3 have different frequencies at which sound absorption is maximum according to the difference of the porosities. In other words, with the material S1, the sound absorption is maximum at a relatively low frequency. With the material S3, the sound absorption is maximum at a relatively high frequency.

In FIG. 16, the axis of ordinates represents the sound absorptivity (%) when acoustic waves are perpendicularly incident over the sound absorbing member.

When a porous sound absorbing material with porosity changing in the thickness direction is employed for the acoustic horn, it is possible to attain the maximum sound absorptivity at a certain frequency. However when the sound absorbing material has a uniform porosity in the thickness direction of the acoustic horn, it is very difficult to obtain the maximum sound absorptivity as shown in FIG. 16.

Therefore when the acoustic horn is made of a porous sound absorbing material which has the maximum sound absorptivity at the same frequency as the resonance frequency, the resonance peak $f\alpha$ can be offset by the sound absorptivity peak $f\alpha'$.

The acoustic horn 60 for the speaker system 58 of FIG. 12 is composed of a porous sound absorbing material which can effectively offset the resonance peak of the horn 60. The acoustic characteristics of the speaker system 58 is shown by the curve 203 in FIG. 17. As can be seen, the acoustic horn 60 is composed of the porous sound absorbing material having the porosity changing in the thickness direction, and the resonance peak $f\alpha$ and the sound absorptivity peak $f\alpha'$ are made equal. Therefore, the acoustic characteristics are flat in the speaker system 58.

In summary, although it is very compact, the speaker system 58 can offer very powerful low tones and assure excellent acoustic characteristics. The speaker system 58 is optimum for a television receiver which requires a very small speaker cabinet.

Since the porous sound absorbing material is ventilative and permits the air to flow freely through the acoustic horn, a shielding layer 62 is disposed on the rear side of the acoustic horn 60 as shown in FIG. 13. Such free flow of the air is not desirable with respect to the acoustic characateristics of the speaker system.

In the foregoing embodiment, the shielding layer 62 is composed of resin, for example. In addition, the shielding layer may be of a material having a very small porosity.

The porous sound absorbing material may be of a foam metal.

According to the invention, although the cabinet is very small, the speaker system can offer very powerful low tones in a device which has a very limited space for the speaker system.

What is claimed is:

1. A speaker system comprising:

(a) a hollow cabinet including on its front panel a sound radiating aperture;

(b) a speaker unit disposed in said hollow cabinet; and (c) an acoustic horn for receiving sound from the front side of said speaker unit and for transmitting the sound to said sound radiating aperture and directly in contact and supporting said speaker unit;

wherein said acoustic horn is cone-shaped with a first and second major surface, with its diameter being gradually increased from a sound receiving aperture to the sound radiating aperture, and is provided with at least one reflected-sound aperture, a sound absorbing material contained solely within and filling the reflected sound aperture and forming with said acoustic horn a continuous single surface on each of said first and second major surfaces, so that the sound coming from the rear of said speaker unit and reflected by a rear panel of said hollow cabinet is guided into the internal space of said acoustic horn.

2. A speaker system according to claim 1, wherein said acoustic horn is composed of a porous sound absorbing material.

3. A speaker system according to claim 2, wherein said acoustic horn composed of said porous sound absorbing material has a porosity which gradually increases from an inner surface where sound impinges to an outer surface of said acoustic horn.

4. A speaker system according to claim 3, wherein a sound absorbing peak frequency of said porous sound absorbing material is equal to a resonance frequency of said acoustic horn.

5. A speaker system according to claim 4, wherein said reflected sound aperture is disposed in the vicinity of said sound transmitting aperture of said acoustic horn.

6. A speaker system according to claim 1, wherein an acoustic port is disposed so as to be joined with said reflected sound aperture in said hollow cabinet.

* * * * *